United States Patent [19]

Singleton et al.

[11] 3,969,212

[45] July 13, 1976

[54] REINFORCED HANGER BRACKET FOR ELECTROPLATING BARREL AND METHOD OF REINFORCING A PLASTIC BAR

[75] Inventors: Albert Singleton, Middleburg Heights; Carel H. Neffenger, Elyria, both of Ohio

[73] Assignee: The Albert Singleton Corporation, Cleveland, Ohio

[22] Filed: Apr. 3, 1975

[21] Appl. No.: 564,809

[52] U.S. Cl. ..... 204/213; 156/303.1; 204/214; 259/89; 264/248

[51] Int. Cl.[2] ..... C25D 17/06; C25D 17/20; B29D 3/00; B01F 9/00

[58] Field of Search ..... 264/248; 156/303.1, 156/268, 293, 257, 244, 91; 204/213, 214; 259/89; 248/13, 14

[56] References Cited

UNITED STATES PATENTS

| | | | |
|---|---|---|---|
| 1,825,427 | 9/1931 | Siddall | 156/303.1 X |
| 2,315,272 | 3/1943 | Potthoff | 204/213 |
| 2,330,497 | 9/1943 | Larmour | 156/303.1 X |
| 2,741,463 | 4/1956 | Colclesser | 259/89 |
| 3,074,117 | 1/1963 | Carpenter et al. | 156/303.1 |
| 3,703,428 | 11/1972 | Poling et al. | 264/248 X |

*Primary Examiner*—Howard S. Williams
*Assistant Examiner*—A. C. Prescott
*Attorney, Agent, or Firm*—Fay & Sharpe

[57] ABSTRACT

A hanger bracket for supporting a rotatable barrel within a fluid treatment tank, which bracket is in turn mounted on a support frame. A metal strip is sealed within the plastic hanger bracket in fluid tight arrangement to strengthen the bracket against bending and twisting. The bracket itself is curved inwardly from its connection to the frame toward its connection with the barrel to compensate for changes in the length of the barrel due to thermal expansion and contraction when the barrel is moved from one environment to another.

17 Claims, 11 Drawing Figures

REINFORCED HANGER BRACKET FOR ELECTROPLATING BARREL AND METHOD OF REINFORCING A PLASTIC BAR

BACKGROUND OF THE INVENTION AND BRIEF DESCRIPTION

Parts of the background of the invention are set out in U.S. Pat. Nos. 3,668,103 and 3,767,504 and to the extent necessary for an understanding of this invention, the two patents are incorporated herein by reference.

Using a metal strip embedded in a plastic body to reinforce the body against bending and twisting is described broadly in both the above cited patents. The metal strip is oriented such that it will best minimize bending in one particular direction and certainly minimize all bending to some extent. The fluid tight plastic enclosure is usually necessary to protect the metal strip from the corrosive atmosphere is which the apparatus operates.

The prior art provides for a metal strip having a thickness T, a width W, and a length L. A groove is cut in the plastic body to house the metal strip with the thickness of the groove being slightly greater than T, the depth being slightly greater than W, and the length being slightly greater than L. It is desired to have as little play as possible between the sides of the groove and the strip because the reinforcing against bending is active only when the force is acting on the metal strip. A strip of plastic is laid over the metal strip and then a weld bead of compatible plastic is laid over the plastic strip, thereby melting both sides of the groove and a part of the plastic strip to bond all three together in a melting and solidifying sequence. This invention has improved on both the method of reinforcing the plastic bar as well as improving the stability of the hanger bracket.

For convenience, a brief description will be made of the hanger bracket although, as explained subsequently, the method itself used in the hanger bracket construction is broadly applicable in other structural embodiments including those similarly involved in fluid treatment barrels such as are used in electroplating, phosphating, or the like.

The prime problem with the prior art is maintaining the fluid tight envelope around the metal bar and if a break occurs, it occurs when the plastic weld material contacts the metal bar directly during the welding process and thereby bonds to it. The particular welding mechanism described in the two above cited patents is somewhat more delicate than the designs submitted herewith which are substantially less complex in terms of the ease of assembly and degree of skill necessary in the assembly. Instead of the two step sequence provided before of laying a plastic strip of width T over the metal strip and then welding over the plastic strip, in this instance a plastic rod much greater in width than T is welded flush with one face of the plastic bar to be strengthened or reinforced. A groove is previously cut in the bar, the rod, or both, of a size to accommodate the metal strip which is oriented in the desired direction.

Stated differently, the groove may be cut completely in the bar to be strengthened, in the rod to be welded to the bar or partially in each so long as the result is a groove of a size to accommodate the metal strip in free floating condition with minimum play. A plastic bead is then laid completely around the edge of the rod where it is juxtaposed to the bar to weld the bar and rod together as a unit. In this manner the plastic weld completely seals the metal strip in fluid tight confinement within the bar-rod envelope and there is no danger of the plastic melt bonding to the bar itself because of the distance of the plastic weld from the strip.

Where small problems existed in the past with melt adhereing to the metal strip, the integrity of the plastic envelope would sometimes be impaired by a tearing of the delicate membrane over the metal strip upon sequential heating and cooling due to the differential in coefficient of thermal expansion between the plastic and the metal. As a general rule, polypropylene or the like is the plastic material comprising the rod and bar as well as the weld material; and as is well known, polypropylene has a higher coefficient of thermal expansion than the preferred steel strip. As a consequence, the obvious would occur and where the plastic had bonded to the steel at spaced apart locations the plastic would either break loose from the steel on the first heating or cooling or else it would tear the plastic weld bead and allow corrosive fluids to pass through the break and corrode the metal strip.

The improvement here removes the plastic weld to more remote positions relative to the metal strip and thus eliminates any possibility of a plastic bond to the metal strip.

In conventional electroplating activities the electroplating fluid in the tanks is sometimes heated to 195°F. As a result the barrels which are dipped into the electrolyte are heated from ambient temperatures to roughly 195°F. The result is a thermal expansion of the barrel in length of up to ¼ inch on some occassions (on a 36 inches long barrel). Considering this situation and the fact that there are two hanger brackets, one at each end of the barrel, manufacturers in the past have traditionally done one of two things to compensate for this expansion:

a. Arrange the hanger brackets on the barrel support frame such that they are spaced apart a distance of up to ⅛ inch greater than is necessary to firmly support the barrel at ambient temperatures. Obviously, this arrangement allows the barrel to slop back and forth on the hubs until it is heated to the extent that the hubs of the barrel are in proper abutting arrangement with the hanger brackets. The result is clear, (1) excess wear due to a sloppy fit, (2) excess bending of the hanger brackets as the loaded barrel oscillates back and forth and differential wear on the gear teeth of the idler gear and the barrel gear.

b. The hanger brackets are initially arranged a distance apart such that there is a relatively tight fit of the barrel between the hanger bracket at ambient temperatures in which case, when the barrel is immersed in the hot electrolyte it expands the length of the barrel. This deflects the hanger brackets and slightly misaligns the teeth of the drive gear mounted on the drive shaft, the idler gear mounted on the hanger bracket, and the driven barrel gear mounted on the hub of the barrel. The obvious problem here is that the teeth of the gears involved will become more worn in some places than in others and in addition the bending moment resulting from the drive gear will be multiplied by a lengthening lever arm the more the hanger bracket bends. Additionally the bending can cause some binding between the hub and the circumferential bearing around the hub.

In this invention the hanger brackets are first constructed in the novel manner herein disclosed with the metal bar embedded in free floating condition within the bracket, in fluid tight confinement and then the hanger bracket is given a prestressed camber or deflection inward toward the barrel. Obviously, it is the metal strip which is deformed rather than the polypropylene which has much greater flexibility. Subsequently, the idler gear is mounted in proper position with consideration of the slight deflection.

Angle irons are conventionally used to join the bracket to the barrel support frame. A pair are welded to opposite edges of a U-shaped channel which serves as a lift bar for the frame. The downwardly extending pair of angle irons are bolted to upwardly extending legs of the bracket. This invention provides an improvement over the prior art by using longer angle irons which extend about halfway down the bracket. The longer angle irons minimize deflection of the bracket beyond the straight line point and thereby minimize misalignment of gear teeth.

Some barrels used in conventional apparatus are not gear driven. Rather, they are driven by V-belts. Some belt driven barrels use rather long hanger brackets and only by using the novel sealed, metal strip reinforced hanger brackets as herein disclosed can gear driven barrels be substituted for V-belt driven barrels. Twisting and bending hanger brackets are not so severe a problem with flexible and resilient V-belts as similar twisting and bending would be with a gear drive. To substitute gears for belts the bracket must have proper rigidity to ensure proper teeth engagement. With particularly long hanger brackets, a plurality of idler gears may be mounted on the hanger bracket and it is clear that the longer the bracket, the more rigid must it be to maintain proper gear teeth engagement. It is an object of this invention to provide a suitably rigid hanger bracket for a plurality of idler gears and even to support the drive shaft. It has been demonstrated experimentally that virtually any fluid is a lubricant for plastic. Consequently, when the apparatus disclosed is operated according to design instructions the electrolyte in the treatment tank serves to lubricate the support axle of an idler gear where it rotates in the cylindrical bearing in the hanger bracket. Unfortunately, some persons do not operate the equipment as it was designed to operate. Conventionally, the idler gear is partially immersed when the barrel rotates. Occasionally, the level of electrolyte is not maintained or the barrel is not fully immersed. Thus, the idler gear bearing gets no lubrication. Normally the bearing operates at just over 200°F. However, without the electrolyte lubrication, normal barrel rotation causes the dry bearing to heat above 450°F. within ten minutes and the idler gear shaft melts. To protect against inadvertant improper operation the improved hanger bracket of this invention provides a self contained lubricant reservoir and passage means to the bearing-idler gear shaft interface.

A brief description of the drawings follows along with a more detailed description of the preferred embodiment which will more completely explain the novel concepts and structures involved.

DESCRIPTION OF THE PREFERRED EMBODIMENTS

Figure 1:
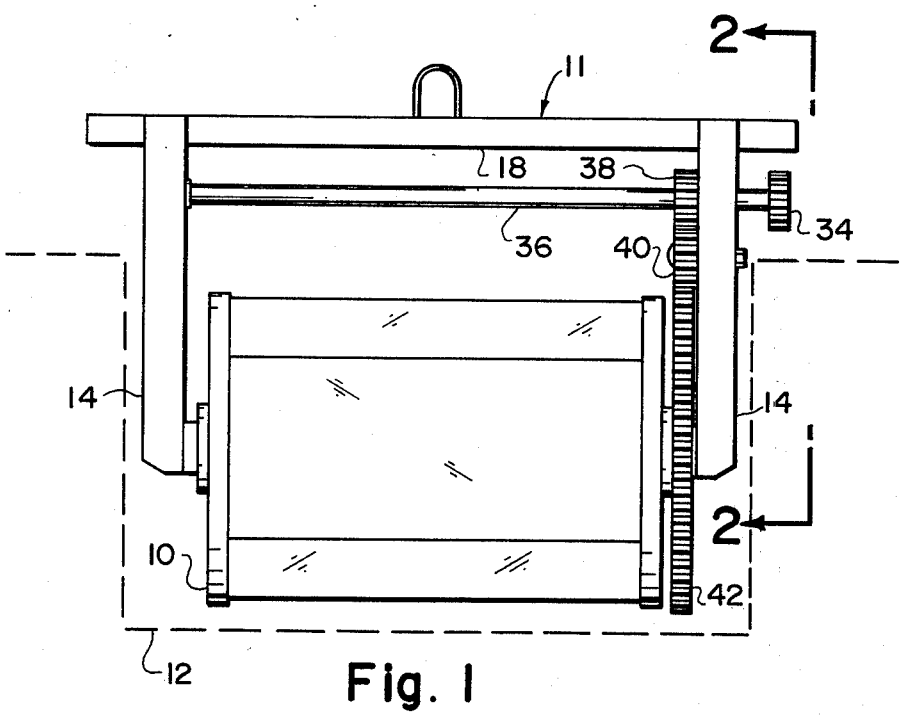
FIG. 1 is a diagrammatic elevational view of the arrangement of a plating barrel, a support frame and the bridging hanger brackets.

Considering FIG. 1, an electroplating barrel 10 is schematically shown located within an electroplating tank 12, shown illustratively by dashed lines, with said tank containing an appropriate treating fluid or electrolyte, not shown. The barrel 10 is supported within the tank by hanger brackets 14 which in turn are connected to a support frame 16, the barrel rotating about a horizontal axis passing through and approximately perpendicular to the hanger brackets.

The support frame 16 is shown only schematically and is illustrated in more detail in a number of other patents well known to those having odinary skill in the art including those two patents cited above. However, for the purpose of illustrating the instant invention the structure shown appears adequate.

Figure 2:
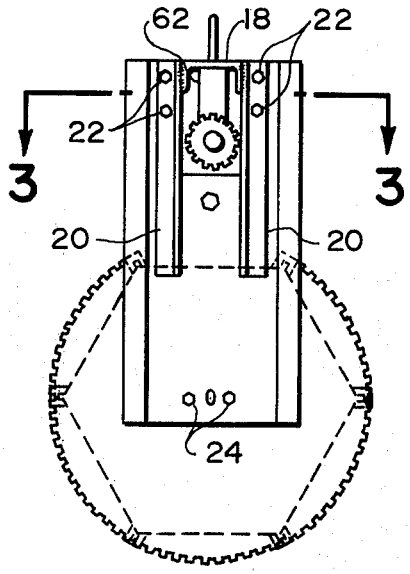
FIG. 2 is a diagrammatic end view of the structure of FIG. 1 taken along line 2—2.
Figure 3:
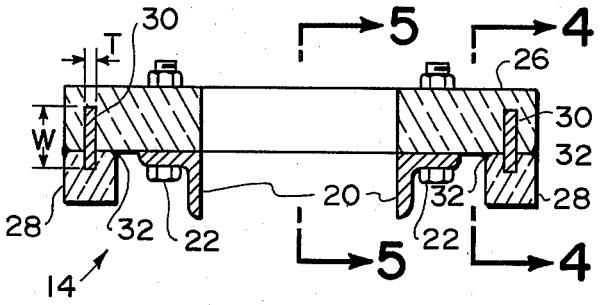
FIG. 3 is a fragmentary sectional view taken along line 3—3 of FIG. 2.

A part of the support structure includes a U-shaped channel or lifting bar 18 extending the length of the barrel and at each end it has welded thereto a pair of elongated angle irons 20, best illustrated in FIGS. 2 and 3. Elongated angle irons 20 are bolted to the hanger bracket by machine screws 22 and if desired the angle irons themselves may be slotted at the bolt holes to allow vertical adjustment of the hanger bracket. The slots are not shown merely for convenience.

The faces of the angle irons 20 adjacent the hanger bracket are planer, that is, they are straight rather than curved for reasons which will be explained subsequently. The hanger bracket itself may be constructed in a number of ways and as illustrated in this embodiment it is primarily a single piece of resin or plastic material 26, preferably polypropylene having a slot cut out at its upper end to accommodate the channel 18. Appropriate apertures are provided extending through the bracket for mounting the support hub for the plating barrel such as the machine screws 24 illustrated in FIG. 2. However, the hanger bracket itself could be two side bars with bridging supports therebetween welded together to form a rigid U-shaped, H-shaped or square A-shaped structure, as desired. The particular geometric shape of the elevational view of the hanger bracket itself is not particularly significant as long as it is appropriately bonded together as a unitary structure. The polypropylene itself is perfectly adequate to support the electroplating barrel and its contents in tension. The reason for providing some reinforcing is to minimize bending and torsion.

The reinforcing is provided herein by cutting a groove on each side of the plastic bar portion 26 of the bracket and a mating groove in two plastic rods 28 which are welded at 32 to the face of the bar 26 on the side of the bracket opposite the location of the barrel. The weld is made by providing clean flush surfaces on the abutting portions of the bar 26 and rod 28 and laying a bead of plastic weld material 32 at the juncture of the two completely around the edge of the rod 28 such that the metal strip 30, preferable low carbon steel previously deposited in the accommodating groove, is completely sealed off from the atmosphere and the associated acids, alkalies and electrolysis. The atmosphere in a normal plating operation is corrosive to steel and to prolong the life of the hanger bracket it is necessary to shield the reinforcing strip 30. Of course, some steps are taken to protect the bolts 22 and 24 and angle irons 20 by coatings but they can be more easily replaced than the reinforcing bar 30.

It is clear on review of the structure described that the hanger bracket will inherently be stronger with the embedded reinforcing bars 30 than without them because of the strength against bending inherent in steel and particularly the orientation of the steel strips where the width W (which is greater than the thickness T) is oriented to minimize the bending of the bracket to the left or right as viewed in FIG. 1. The strips 30 will of course minimize the bending in a plane perpendicular to the orientation in FIG. 1 but to a much lesser extent than to the right or left.

Figure 6:
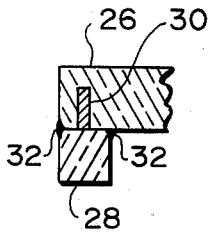
FIG. 6 is a fragmentary sectional view illustrating an alternative metal strip mounting arrangement.
Figure 7:
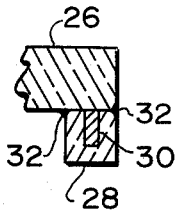
FIG. 7 is a fragmentary sectional view of another alternative mounting arrangement for the metal strip.

Alternative orientations for the position of the metal strip 30 are illustrated in FIGS. 6 and 7 and they are the functional equivalent of the structure illustrated in FIG. 3. There is no real difference functionally regardless of whether the strip is located in a groove cut only in the bar 26 as illustrated in FIG. 6, a groove cut only in the rod 28 (FIG. 7) or a composite groove cut in both (FIG. 3). The object of making the relatively large rod 28 serve as a cap over the metal strip 30 is to provide a greater distance between the weld 32 and the surface of the strip 30. This prevents the metal strip from acting as a heat sink which prevents the sequential melting and solidifying of both the contacting surfaces of the bar and rod such that they melt together to form a fluid tight bond. Additionally, the remote location of the strip prevents the weld from bonding to the metal strip 30 and perhaps, on expansion and contraction, impairing the integrity of the fluid tight envelope designed for the metal strip 30.

Figure 4:
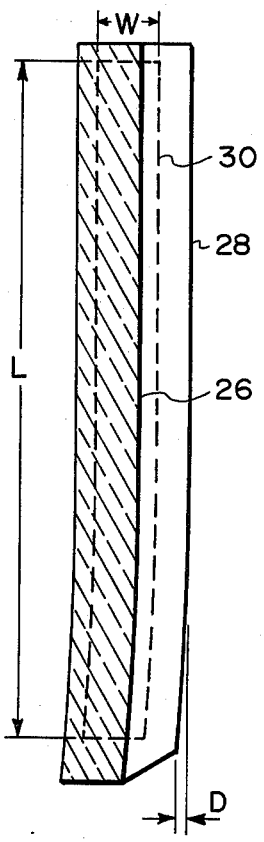
FIG. 4 is a sectional view taken along line 4—4 of FIG. 3.
Figure 5:
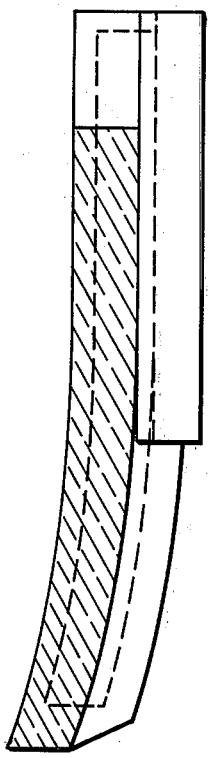
FIG. 5 is a sectional view taken along line 5—5 of FIG. 3.

After the metal strip is sealed in the groove (which is only slightly larger than the metal strip) the hanger bracket is deflected such that the metal strip 30 is permanently deformed in a curve inward toward the barrel from the support apparatus. Deformation of the metal strip 30 places the bar 26 in a prestressed condition with the inherent physical properties. The deflection D (FIGS. 4 and 5) from a straight line should never be more than ⅛ inches, and the reasons for giving the deflection and how the elongated angle irons 20 serve as a second reinforcing means will be explained more easily by reference to the mode of operation of the apparatus which follows.

As in conventional apparatus, when the support frame 16 is positioned properly on a tank 12, the first drive gear 34 is driven by a stationary motor (not shown) mounted on the tank. The drive shaft 36 drives the second drive gear 38 which rotates the idler gear 40 which is mounted directly on the hanger bracket. In fact, one face of the idler gear is flush with the surface of the bracket to minimize the bending moment on the idler gear axle. The idler gear 40 turns the barrel gear 42 which is preferably mounted to rotate with the barrel 10.

The specially constructed (curved) hanger brackets are initially mounted on the frame and joined to the barrel at ambient temperatures and with a relatively tight fit so there is no back and forth slippage of the barrel on the hubs. However, on immersing the barrel into the tank of hot electrolyte, for example, up to 195°F, the barrel lengthens due to thermal expansion, possibly up to ¼ inches in length. As the barrel lengthens it deflects outwardly the previously inwardly deflected hanger brackets until at maximum barrel length the brackets will be no more than roughly straight in a vertical plane. All this while, the pressure of the inwardly deflected hanger brackets will maintain the barrel in smoothly rotating condition without the barrel being buffeted back and forth between loose limitations of the hanger brackets.

A second reinforcing means is embodied in the elongated angle irons 20 which provide that the upper portion of the hanger cannot be deflected beyond a substantially straight vertical line. The reason for this is to prevent misalignment of the teeth on the gears 38, 40, and 42. With the second reinforcing means as shown, even at elevated temperatures the relative horizontal displacement of the gear 40 will be negligible and substantially full tooth engagement is assured.

Figure 8:
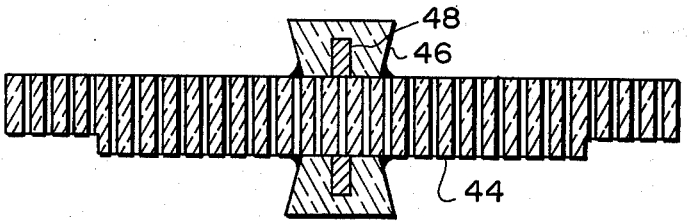
FIG. 8 is a sectional end view of a door of an electroplating barrel constructed according to the instant invention.

FIG. 8 illustrates an end view of a conventional porous door 44 of an electroplating barrel which, for the purpose of this discussion may be considered the bar. The handle 46 (rod) of generally tapering configuration has a groove cut therein and housed in the groove is a metal strip 48. In the particular embodiment shown a structure identical to handle 46 and strip 48 is shown welded onto the inside surface of the door but this is purely optional where one might want to have greatly enhanced reinforcement against bending. What is absolutely necessary of course is a bonding of some sort of material on the inside surface of the door to prevent the electrolyte from migrating through the pores of the door to the metal strip 48.

Figure 9:
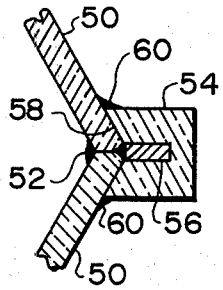
FIG. 9 is a fragmentary sectional view of one corner of an electroplating barrel having a reinforcing corner rib constructed according to this invention.

FIG. 9 illustrates two angularly converging sides 50 (equivalent of the bar 26) which are welded together in conventional manner at 52. A plastic rod 54 has a groove cut therein to house a metal strip 56 and then the face 58 of the rod 54 is reshaped to lie flush with the surface of the angularly diverging walls 50 such that a bead of plastic weld 60 laid completely around the periphery of the rod 54 will seal the strip 56 in fluid tight arrangement to prevent the encroachment of any corrosive fluids from the electrolyte.

Figure 10:
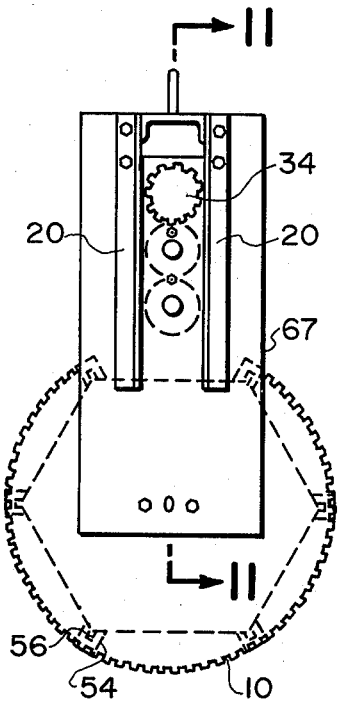
FIG. 10 is an end elevational view of the improved hanger bracket of this invention, for convenience shown without the reinforcing bars.
Figure 11:
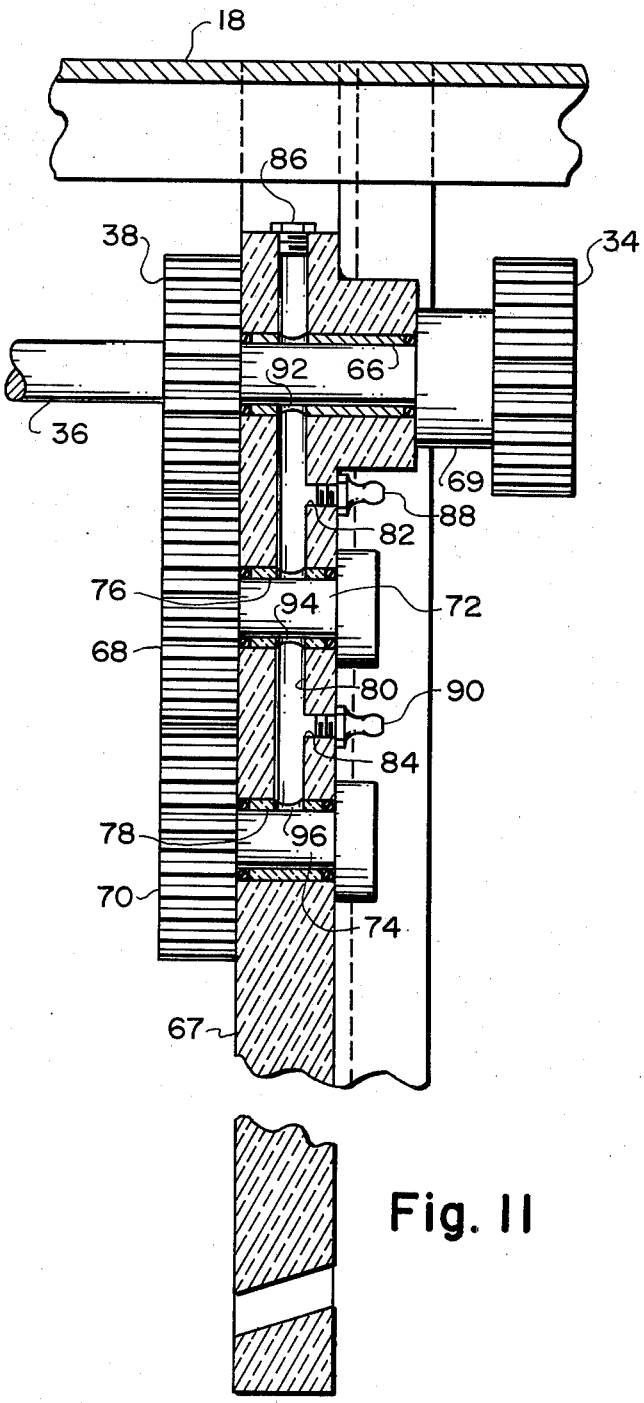
FIG. 11 is a sectional view taken along line 11—11 of FIG. 10.

It is only by using the duel reinforcing strips 30 located generally as shown in FIG. 3 that it is possible to achieve the degree of rigidity necessary to allow for a long hanger bracket using a gear drive. FIGS. 1 and 2 illustrate a conventional gear drive and FIGS. 10 and 11 illustrate a more elongated bracket with two idler gears. For convenience in illustrating other novel features, the duel reinforcing strips and camber have omitted from FIGS. 10 and 11 but they should be considered incorporated therein as necessary for proper bracket rigidity and a tightly supported barrel.

The bar or bracket body 26 of FIGS. 1 and 2 is generally U-shaped with the drive shaft supporting gears 34 and 38 extending through the legs of the U-shape. Bearing blocks 62, one at each end, are bolted to the lifting beam 18 and include a cylindrical aperture to receive the drive shaft 36. The bearing blocks 62 being the only supports holding the shaft, it was conceived that greater shaft stability could be achieved by passing the shaft through a bearing in the bracket body. Similarly, with the shaft suspended by the bracket rather than the lifting beam 18, closer fitting tolerances could be maintained. All related shafts for rotation are thus supported in bearings in one integral piece of plastic. FIGS. 10 and 11 illustrate an elongated hanger bracket 64 having the usual drive shaft 36 and gears 34 and 38. However, the bearing blocks 62 have been eliminated and the legs of the U-shaped bracket 64 shortened such that the shaft 36 passes through an aperture in the bracket and is supported in sleeve bearing 66. Bearing 66, as well as the other sleeve bearings discussed below are preferably polypropylene or graphite filled polypropylene but other plastic or metal bearings may be used if desired.

The body 67 of the bracket is preferably of 1¼ inches thick polypropylene and a one inch boss 69 of similar material is welded to the side of the body opposite from the mounted idler gears. The boss provides for the greater stability by a longer bearing surface.

Two idler gears 68 and 70 are mounted flush with the inside face of the bracket body and are locked to their respective mounting shafts 72 and 74 by pin means, not illustrated. The shafts 72, 74 are designed to rotate within sleeve bearings 76 and 78. Because the barrel 10 is sometimes rotated when it is not completely immersed in the fluid of the treatment tank 12, a reservoir and a network of passages are provided to insure lubrication of the bearings 66, 76, 78. Referring particularly to FIG. 11, a vertical passage 80 is first drilled to intersect each of the bearing supporting aperture through the bracket body 67. Then horizontal passages 82, 84 are drilled to intersect passage 80 between each set of bearings. A plug 86 blocks the upper end of passage 80 and grease fittings 88, 90 are attached at the outlet of each horizontal passage. Note that the grease fittings are disposed on the same side of the bracket body as the boss 69. This provides easy access for frequent injections of grease as may be needed or desired. The passages 80, 82, 84 serve as a reservoir for the grease (or other lubricating material) as well as providing a distribution system for the lubricant.

Note that bearings 66 and 76 include apertures 92 and 94, respectively, which extend completely through the bearing and allow lubrication to penetrate from above or below. However, the lowermost bearing 78 includes an aperture 96 which communicates only with the lubricant passage above. These facts are not critical to the design but merely recognize that no lubricant need pass upward from below to the lowermost bearing. Certainly bearing 76, if substituted for bearing 78, would in no way impair the operability of idler gear 70. This is mentioned merely to show that only one design of bearing need be used for bearings 76 and 78 if such is desired. In that way a workman will not be confused about which bearing to use or an order clerk will not accidentally order the wrong replacement bearing. There should be no difficulty about the difference between bearing 66 and bearings 76 and 78 because of their different lengths. But, the lengths could also be standardized, if desired.

It is clear that a system of seals is necessary in the lubricant passages to prevent leakage of lubricant or to prevent the electroplating fluid from acting as a solvent and dissolving all the lubricant in the passages and reservoir. Several available sealing systems are suitable such as polytetrafluoroethylene rings in compression between the shaft and the aperture wall at each end of each bearing or an O-ring in a groove circumscribing each aperture on each side of the bracket body 67 which O-ring would be in sealing contact with a gear or other flange type projection. For convenience, no particular sealing system is illustrated.

Having thus described the invention in some detail, modifications will be obvious to those having ordinary skill in the art without departing from the scope of the inventive concept. Similarly, the drawings and language used to describe the invention are not intended to be limiting on the invention, rather it is intended that the invention be limited only by the scope of the appended claims.

We claim:

1. An improved hanger bracket for supporting a rotatable barrel within a fluid treatment tank wherein the bracket is connected to the barrel by means for allowing the barrel to rotate relative to the bracket about an axis passing through the bracket and to a barrel support frame which in turn may be supported on the tank, said bracket being constructed of a resin material having encased therein, in fluid tight arrangement, a metal strip to strengthen the bracket against bending, said strip having a width W, a thickness T, and a length L, the improvement comprising, said bracket being curved inward from its connection with the frame toward its connection with the barrel to compensate for changes in barrel length due to thermal expansion and contraction of the barrel.

2. The bracket of claim 1 including a rod of resin bonded by welding to the bracket, said rod extending parallel with said metal strip and extending beyond each end of said metal strip, a groove in one of said bracket and rod, said metal strip being disposed in said groove.

3. The bracket of claim 2 including second reinforcing means connected to said bracket to prevent the portion of the bracket nearest the support frame from being deflected in a direction away from the barrel beyond the position where the initially inwardly curved bracket surface has been deformed to a planer surface.

4. The bracket of claim 3 wherein the second reinforcing means comprises two straight parallel extending angle irons connected to the upper portion of the bracket near the support frame, said angle irons extending downward toward the barrel about half the length of the bracket.

5. The bracket of claim 4 wherein the resin rod and the angle irons are connected to the bracket on the side opposite from the barrel connection.

6. The bracket of claim 1 including second reinforcing means connected to said bracket to prevent the portion of the bracket nearest the support frame from being deflected in a direction away from the barrel beyond the position where the initially inwardly curved bracket surface has been deformed to a planer surface.

7. The bracket of claim 6 wherein the second reinforcing means comprises two straight parallel extending angle irons connected to the upper portion of the bracket near the support frame, said angle irons extending downward toward the barrel about half the length of the bracket.

8. The bracket of claim 7 wherein the angle irons are connected to the bracket on the side opposite from the barrel connection.

9. The bracket of claim 2 including two rods and two metal strips oriented parallel to each other and approximately perpendicular to the axis of barrel rotation.

10. The bracket of claim 2 wherein the rod is welded to the bracket on the opposite side from the barrel connection.

11. A method of reinforcing a plastic bar to strengthen it against bending forces comprising the steps of:

providing a rigid strip of metal reinforcing having a width W, a thickness T, and a length L;

providing a plastic rod of a material having properties which allow it to be welded to the plastic bar;

forming a groove in one of (1) the plastic bar and (2) the plastic rod, of a length and width to accommodate the metal strip;

placing the strip in the groove and placing the bar and rod in contact such that the strip is completely covered; and welding the rod and bar together such that the strip is completely encased in a fluid tight compartment formed by the bar and rod.

12. The method of claim 11 wherein the bar comprises a hanger bracket for supporting a rotatable barrel, providing two strips, two rods and two grooves in parallel positions and adjacent opposite edges of said hanger bracket.

13. The method of claim 11 wherein said bar comprises a door of a porous rotatable barrel and said rod comprises a door handle, providing the groove in the handle and welding the handle to the outer face of the door and welding a plastic strip to the opposite side of the door to prevent fluid contact of the metal strip by migration through the pores of the door.

14. The method of claim 11 wherein the bar comprises two angularly positioned sides of an electroplating barrel, said sides being welded together at the apex of the angle joining the two, providing the groove in one face of the plastic rod, reforming said one face of said plastic rod such that it fits flush with the surfaces of the joined sides with the metal strip substantially aligned parallel with said apex.

15. The method of claim 12 wherein the bracket includes apertures therethrough and disposed in said apertures are sleeve bearings circumscribing support shafts, the step of forming passage means in said bracket, said passage means being in fluid communication with the bearings for serving as a reservoir for lubricant and as a distribution for said lubricant.

16. The bracket of claim 1 including apertures therethrough, bearing means within said apertures for supporting rotatable shafts, means forming a reservoir and distribution system for providing lubrication for said bearings.

17. An improved hanger bracket for supporting a rotatable barrel within a fluid treatment tank wherein the bracket is connected (1) to the barrel by means for allowing the barrel to rotate relative to the bracket about an axis passing through the bracket and (2) to a barrel support frame which in turn may be supported on the tank, said bracket comprising a generally U-shaped plastic body and having encased therein a pair of rigid metal strips, said strips being encased in fluid tight condition within the bracket body to rigidify the bracket against bending and twisting, the improvement comprising, a plurality of apertures through the bracket body, said apertures containing bearing means for supporting a rotatable shaft, means forming a reservoir to hold lubricant and a distribution system for providing lubrication for said bearings, said reservoir and distribution system means being contained within the bracket body and being in fluid communication with each of said bearing means.

* * * * *